US006182414B1

(12) United States Patent
Huang

(10) Patent No.: US 6,182,414 B1
(45) Date of Patent: Feb. 6, 2001

(54) WOODEN FLOORBOARD ASSEMBLY

(76) Inventor: Chin-Chih Huang, 8F, No. 11, Lane 288, Yu-Non Rd., Tainan (TW)

( * ) Notice: Under 35 U.S.C. 154(b), the term of this patent shall be extended for 0 days.

(21) Appl. No.: 09/282,032

(22) Filed: Mar. 30, 1999

(51) Int. Cl.[7] ..... E04B 5/00

(52) U.S. Cl. ..... 52/592.1; 52/392; 52/403.1; 403/354

(58) Field of Search ..... 52/403.1, 592.1, 52/392, 588.1, 480, DIG. 1; 403/354

(56) References Cited

U.S. PATENT DOCUMENTS 5,968,630 * 2/2000 Foster ..... 52/403.1
6,021,615 * 2/2000 Brown ..... 52/392
6,029,416 * 2/2000 Andersson ..... 52/592.1

* cited by examiner

*Primary Examiner*—Beth A. Stephan
(74) *Attorney, Agent, or Firm*—Alan Kamrath Oppenheimer Wolff & Donnelly LLP

(57) ABSTRACT

A wooden floorboard assembly has a foamed plastic layer, a carpet layer disposed on the foamed plastic layer, at least a first and a second wooden floorboards. The first wooden floorboard has a first wooden plate, a first hook-and-loop-type fastener pad adhered on a bottom of the first wooden plate, and the first wooden plate having a first protruded portion and a first recessed portion. The second wooden floorboard has a second wooden plate, a second hook-and-loop-type fastener pad adhered on a bottom of the second wooden plate, and the second wooden plate having a second protruded portion and a second recessed portion. The first recessed portion of the first wooden plate engages with the second protruded portion of the second wooden plate.

3 Claims, 4 Drawing Sheets

WOODEN FLOORBOARD ASSEMBLY

BACKGROUND OF THE INVENTION

The present invention relates to a woooden floor-board assembly. More particularly, the present invention relates to a wooden floorboard assembly which is easily assembled.

Referring to FIGS. 4 and 5 first, a conventional wooden plate 40 has two protruded laterals 401 and two recessed laterals 402. Referring to FIG. 4 again, a first wooden plate 40, a second wooden plate 40, and a third wooden plate 40 are assembled together. Referring to FIG. 5 again, a veneer plate 30 is disposed beneath the first wooden plate 40 and the second wooden plate 40. The recessed lateral 402 of the first wooden plate 40 engages with the protruded lateral 401 of the second wooden plate 40. A wooden panel 10 is disposed beneath the veneer plate 30. A nail 20 fastens the veneer plate 30 and the wooden panel 10 together. However, the user has to use a large number of nails 20, veneer plates 30, and wooden panels 10 in order to assemble a large number of wooden plates 40 together. Furthermore, it consumes a lot of manpowers to assemble the wooden plates 40. If the user is not a skilled carpenter, the user may not be able to assemble the veneer plates 30 and the wooden plates 40 together by himself. If the user does not arrange the veneer plates 30 and the wooden plates 40 carefully, the surfaces of the wooden plates 40 will not be very smooth. When one of the conventional wooden plates 40 is broken, it is difficult to detach the conventional wooden plate 40.

SUMMARY OF THE INVENTION

An object of the present invention is to provide a wooden floorboard assembly which is easily assembled.

Another object of the present invention is to provide a wooden floorboard assembly which has less elements than a conventional floorboard assembly so that the wooden floorboard assembly of the present invention will not consume a lot of manpowers while assembling.

Another object of the present invention is to provide a wooden floorboard assembly which has a plurality of wooden floorboards to be detached easily.

Another object of the present invention is to provide a wooden floorboard assembly which has a plastic laminate placed beneath a wooden plate before the wooden plate is arranged to a predetermined position so that the hook-and-loop type fastener pad of the wooden plate will not be adhered on a carpet before the wooden plate reaches the predetermined position.

In accordance with a first preferred embodiment of the present invention, a wooden floorboard assembly comprises a foamed plastic layer, a carpet layer, at least a first wooden floorboard and a second wooden floorboard. The first wooden floorboard comprises a first wooden plate, a first hook-and-loop-type fastener pad adhered on a bottom of the first wooden plate, and the first wooden plate having a first protruded portion and a first recessed portion. The second wooden floorboard comprises a second wooden plate, a second hook-and-loop-type fastener pad adhered on a bottom of the second wooden plate, and the second wooden plate having a second protruded portion and a second recessed portion. The first recessed portion of the first wooden plate engages with the second protruded portion of the second wooden plate. The first wooden floorboard and the second wooden floorboard are disposed on the carpet layer. The carpet layer engages with the first hook-and-loop-type fastener pad and the second hook-and-loop-type fastener pad. The carpet layer is disposed on the foamed plastic layer. The foamed plastic layer is disposed on a floor.

In accordance with a second preferred embodiment of the present invention, a wooden floorboard assembly comprises a foamed plastic layer, a non-woven fabric, at least a first wooden floorboard and a second wooden floorboard. The first wooden floorboard comprises a first wooden plate, a first hook-and-loop-type fastener pad adhered on a bottom of the first wooden plate, and the first wooden plate having a first protruded portion and a first recessed portion. The second wooden floorboard comprises a second wooden plate, a second hook-and-loop-type fastener pad adhered on a bottom of the second wooden plate, and the second wooden plate having a second protruded portion and a second recessed portion. The first recessed portion of the first wooden plate engages with the second protruded portion of the second wooden plate. The first wooden floorboard and the second wooden floorboard are disposed on the non-woven fabric. The non-woven fabric engages with the first hook-and-loop-type fastener pad and the second hook-and-loop-type fastener pad. The non-woven fabric is disposed on the foamed plastic layer. The foamed plastic layer is disposed on a floor.

In accordance with a third preferred embodiment of the present invention, a wooden floorboard assembly comprises a foamed plastic layer, a hook-and-loop-type tape, at least a first wooden floorboard and a second wooden floorboard. The first wooden floorboard comprises a first wooden plate, a first hook-and-loop-type fastener pad adhered on a bottom of the first wooden plate, and the first wooden plate having a first protruded portion and a first recessed portion. The second wooden floorboard comprises a second wooden plate, a second hook-and-loop-type fastener pad adhered on a bottom of the second wooden plate, and the second wooden plate having a second protruded portion and a second recessed portion. The first recessed portion of the first wooden plate engages with the second protruded portion of the second wooden plate. The first wooden floorboard and the second wooden floorboard are disposed on the hook-and-loop-type tape. The hook-and-loop-type tape engages with the first hook-and-loop-type fastener pad and the second hook-and-loop-type fastener pad. The hook-and-loop-type tape is disposed on the foamed plastic layer. The foamed plastic layer is disposed on a floor.

DETAILED DESCRIPTION OF THE INVENTION

Figure 1:
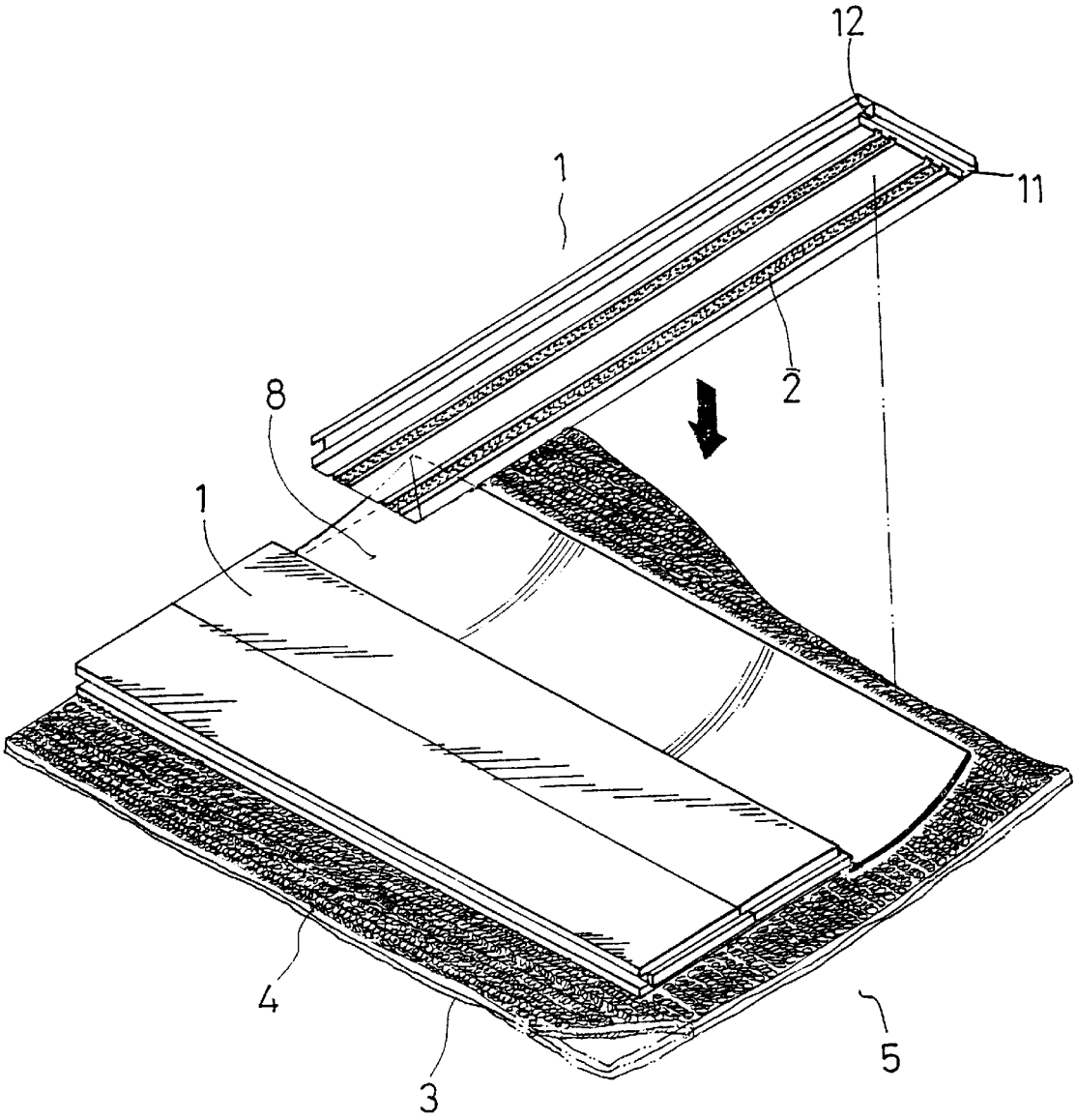
FIG. 1 is a perspective exploded view of a wooden floorboard assembly of a first preferred embodiment in accordance with the present invention.

Referring to FIG. 1, a first wooden floorboard assembly comprises a foamed plastic layer 3, a carpet layer 4, at least a first wooden floorboard and a second wooden floorboard.

The first wooden floorboard comprises a first wooden plate 1, a first hook-and-loop-type fastener pad 2 adhered on a bottom of the first wooden plate 1, and the first wooden plate 1 having a first protruded portion 11 and a first recessed portion 12. The second wooden floorboard comprises a second wooden plate 1, a second hook-and-loop-type fastener pad 2 adhered on a bottom of the second wooden plate 1, and the second wooden plate 1 having a second protruded portion 11 and a second recessed portion 12. The first recessed portion of the first wooden plate 1 engages with the second protruded portion 11 of the second wooden plate 1. The first wooden floorboard and the second wooden floorboard are disposed on the carpet layer 4. The carpet layer 4 engages with the first hook-and-loop-type fastener pad 2 and the second hook-and-loop-type fastener pad 2. The carpet layer 4 is disposed on the foamed plastic layer 3. The foamed plastic layer 3 is disposed on a floor 5. A plastic laminate 8 is placed beneath the second wooden plate 1 before the second wooden plate 1 is arranged to a predetermined position so that the hook-and-loop type fastener pad 2 of the second wooden plate 1 will not be adhered on the carpet layer 4 before the second wooden plate 1 reaches the predetermined position.

When one of the wooden plates 1 is broken, the wooden plates 1 can be detached easily. Since the wooden floorboard assembly is assembled without any nail, the user need not remove the nail at all.

Figure 2:
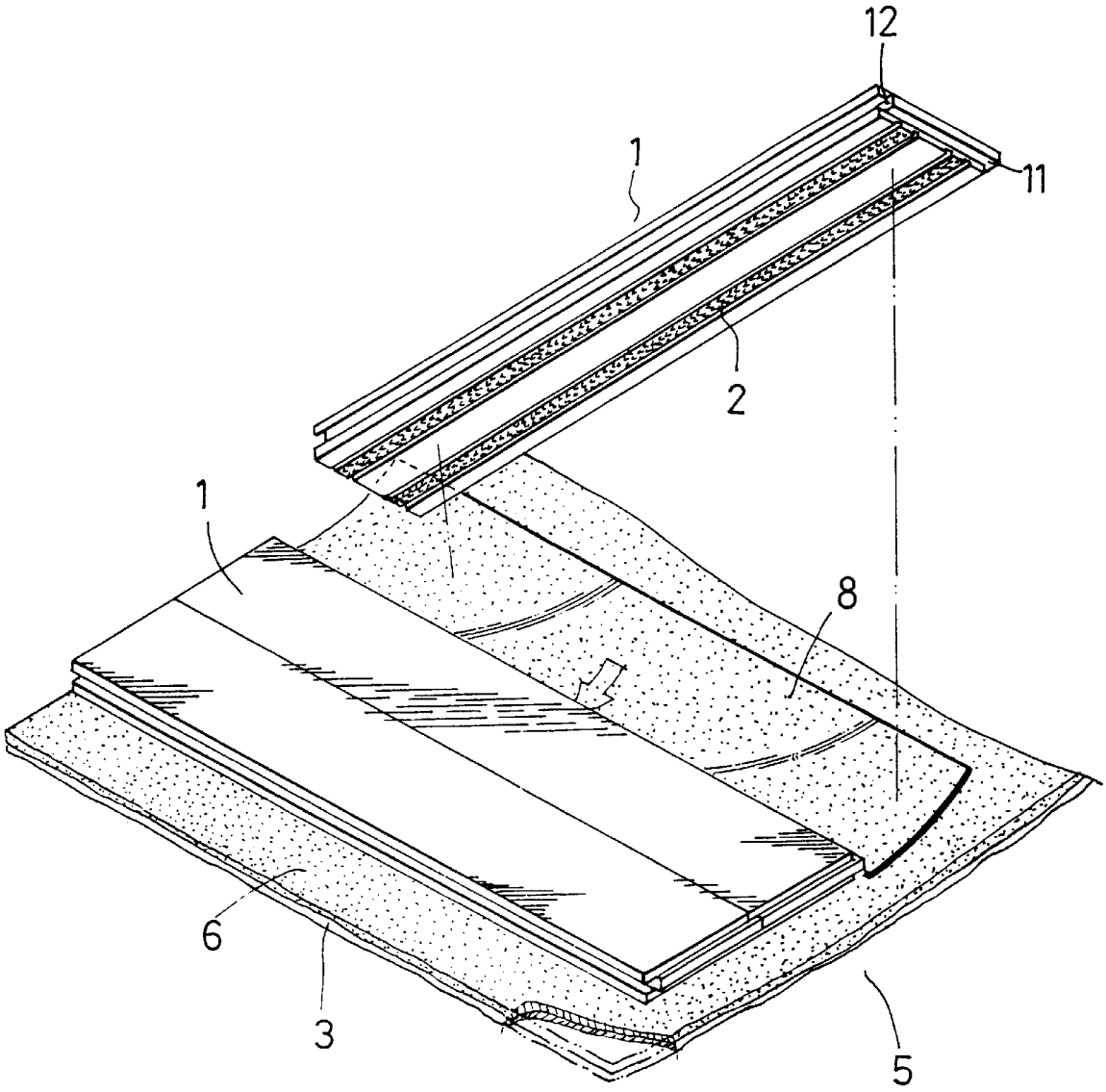
FIG. 2 is a perspective exploded view of a wooden floorboard assembly of a second preferred embodiment in accordance with the present invention.

Referring to FIG. 2, a second wooden floorboard assembly comprises a foamed plastic layer 3, a non-woven fabric 6, at least a first wooden floorboard and a second wooden floorboard. The first wooden floorboard comprises a first wooden plate 1, a first hook-and-loop-type fastener pad 2 adhered on a bottom of the first wooden plate 1, and the first wooden plate 1 having a first protruded portion 11 and a first recessed portion 12. The second wooden floorboard comprises a second wooden plate 1, a second hook-and-loop-type fastener pad 2 adhered on a bottom of the second wooden plate 1, and the second wooden plate 1 having a second protruded portion 11 and a second recessed portion 12. The first recessed portion of the first wooden plate 1 engages with the second protruded portion 11 of the second wooden plate 1. The first wooden floorboard and the second wooden floorboard are disposed on the non-woven fabric 6. The non-woven fabric 6 engages with the first hook-and-loop-type fastener pad 2 and the second hook-and-loop-type fastener pad 2. The non-woven fabric 6 is disposed on the foamed plastic layer 3. The foamed plastic layer 3 is disposed on a floor 5. A plastic laminate 8 is placed beneath the second wooden plate 1 before the second wooden plate 1 is arranged to a predetermined position so that the hook-and-loop type fastener pad 2 of the second wooden plate 1 will not be adhered on the non-woven fabric 6 before the second wooden plate 1 reaches the predetermined position.

When one of the wooden plates 1 is broken, the wooden plates 1 can be detached easily. Since the wooden floorboard assembly is assembled without any nail, the user need not remove the nail at all.

Figure 3:
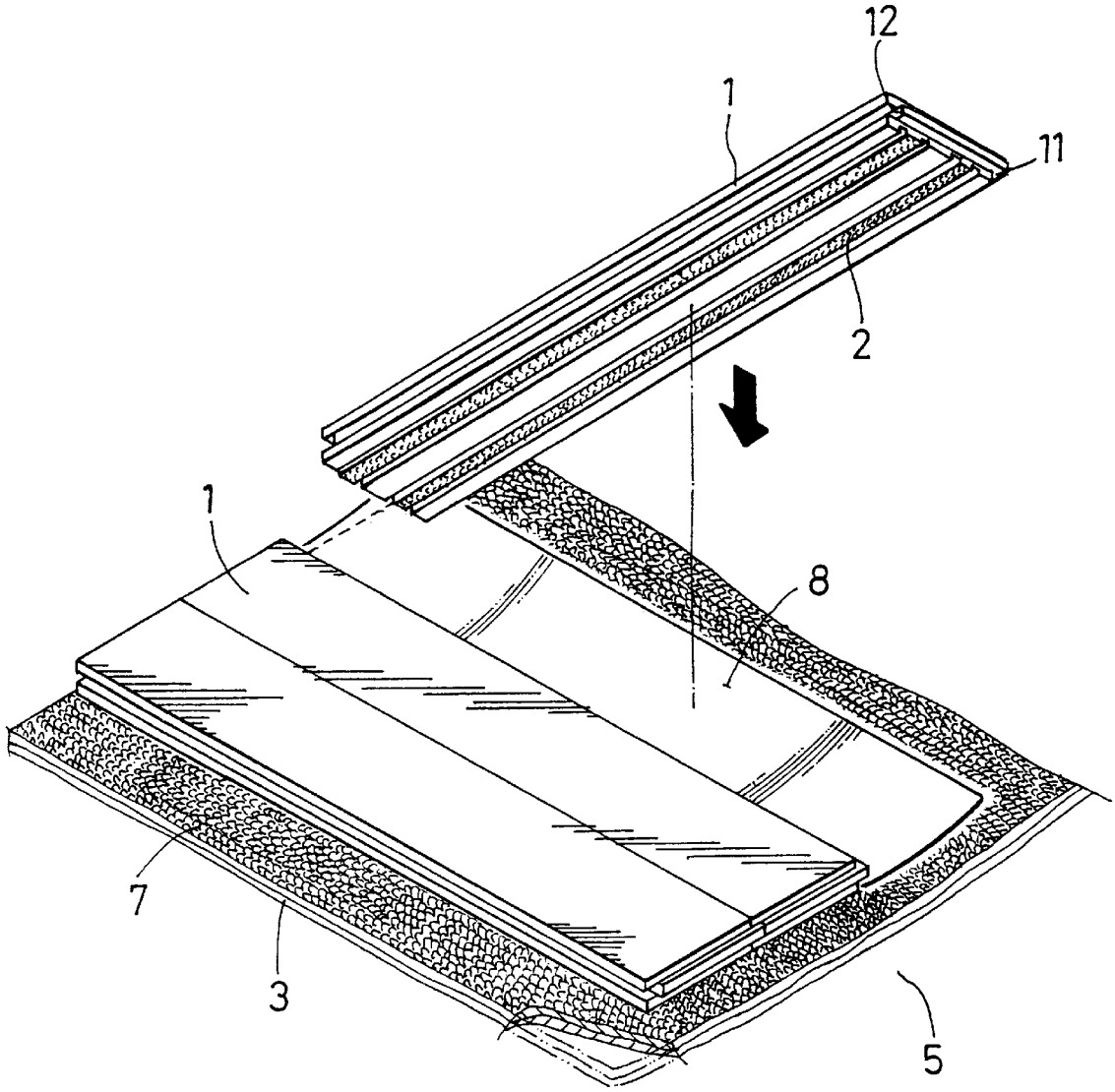
FIG. 3 is a perspective exploded view of a wooden floorboard assembly of a third preferred embodiment in accordance with the present invention.
Figure 4:
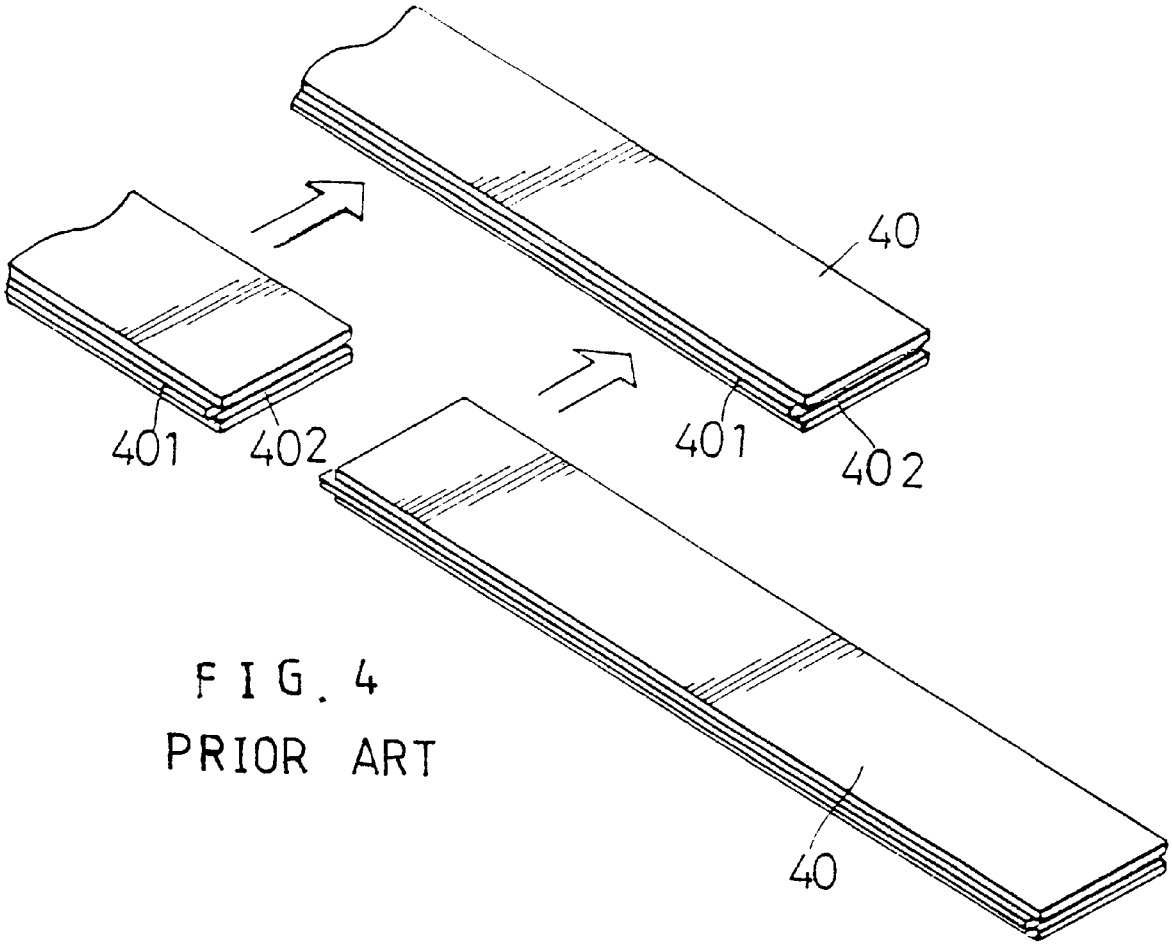
FIG. 4 PRIOR ART
FIG. 4 is a perspective exploded view of a plurality of conventional wooden plates of the prior art.
Figure 5:
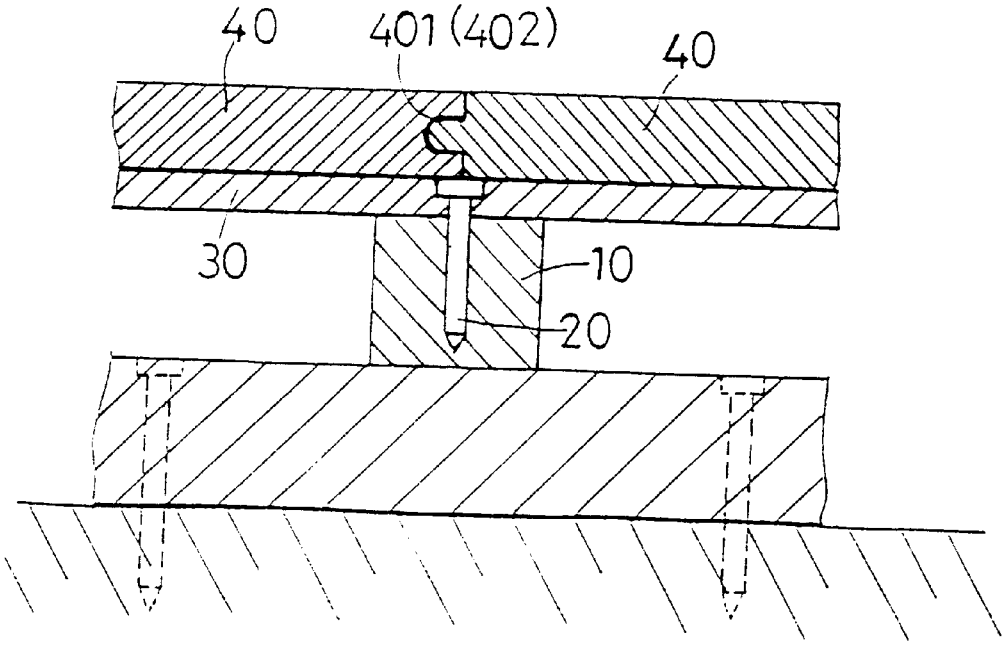
FIG. 5 PRIOR ART
FIG. 5 is a partially sectional assembly view of a plurality of wooden plates of the prior art.

Referring to FIG. 3, a third wooden floorboard assembly comprises a foamed plastic layer 3, a hook-and-loop-type tape 7, at least a first wooden floorboard and a second wooden floorboard. The first wooden floorboard comprises a first wooden plate 1, a first hook-and-loop-type fastener pad 2 adhered on a bottom of the first wooden plate 1, and the first wooden plate 1 having a first protruded portion 11 and a first recessed portion 12. The second wooden floorboard comprises a second wooden plate 1, a second hook-and-loop-type fastener pad 2 adhered on a bottom of the second wooden plate 1, and the second wooden plate 1 having a second protruded portion 11 and a second recessed portion 12. The first recessed portion of the first wooden plate 1 engages with the second protruded portion 11 of the second wooden plate 1. The first wooden floorboard and the second wooden floorboard are disposed on the hook-and-loop-type tape 7. The hook-and-loop-type tape 7 engages with the first hook-and-loop-type fastener pad 2 and the second hook-and-loop-type fastener pad 2. The hook-and-loop-type tape 7 is disposed on the foamed plastic layer 3. The foamed plastic layer 3 is disposed on a floor 5. A plastic laminate 8 is placed beneath the second wooden plate 1 before the second wooden plate 1 is arranged to a predetermined position so that the hook-and-loop type fastener pad 2 of the second wooden plate 1 will not be adhered on the hook-and-loop-type tape 7 before the second wooden plate 1 reaches the predetermined position.

When one of the wooden plates 1 is broken, the wooden plates 1 can be detached easily. Since the wooden floorboard assembly is assembled without any nail, the user need not remove the nail at all.

The present invention is not limited to the above embodiments but various modification thereof may be made. Furthermore, various changes in form and detail may be made without departing from the scope of the present invention.

I claim:

1. A wooden floorboard assembly comprises:

at least a first wooden floorboard and a second wooden floorboard, the first wooden floorboard comprising a first wooden plate, a first hook-and-loop-type fastener pad adhered on a bottom of the first wooden plate, and the first wooden plate having a first protruded portion and a first recessed portion, the second wooden floorboard comprising a second wooden plate, a second hook-and-loop-type fastener pad adhered on a bottom of the second wooden plate, and the second wooden plate having a second protruded portion and a second recessed portion, the first recessed portion of the first wooden plate engaging with the second protruded portion of the second wooden plate, the first wooden floorboard and the second wooden floorboard disposed on a carpet layer, the carpet layer engaging with the first hook-and-loop-type fastener pad and the second hook-and-loop-type fastener pad, and the carpet layer disposed on a foamed plastic layer.

2. A wooden floorboard assembly as claimed in claim 1, wherein the carpet layer is made of non-woven fabric.

3. A wooden floorboard assembly as claimed in claim 1, wherein the carpet layer is made of hook-and-loop-type tape.

* * * * *